United States Patent [19]

Thomas et al.

[11] Patent Number: 4,963,048

[45] Date of Patent: Oct. 16, 1990

[54] NOTE PEN DEVICE

[75] Inventors: Paul R. Thomas; William J. Scott, both of Taylorville, Ill.

[73] Assignee: Notepen, Inc., Okla.

[21] Appl. No.: 113,445

[22] Filed: Oct. 28, 1987

[51] Int. Cl.[5] ..... B43K 29/12; B43K 31/00

[52] U.S. Cl. ..... 401/195; 401/52; 401/99

[58] Field of Search ..... 401/195, 52, 99, 57, 401/30

[56] References Cited

U.S. PATENT DOCUMENTS

| | | | |
|---|---|---|---|
| 493,464 | 3/1893 | Arthur | 401/57 |
| 2,005,110 | 6/1935 | Ritzert | 401/52 |
| 2,073,719 | 3/1937 | Ross | 401/195 X |
| 2,111,362 | 3/1938 | Fisher . | |
| 2,512,168 | 6/1950 | Moore | 401/195 X |
| 2,601,650 | 6/1952 | Walter et al. | 401/52 |
| 2,865,533 | 12/1958 | Taylor | 401/52 X |
| 3,552,869 | 1/1971 | Johnson . | |
| 3,963,358 | 6/1976 | Houser . | |
| 3,985,455 | 10/1976 | Wahlberg | 401/30 |
| 4,030,842 | 6/1977 | White et al. . | |
| 4,327,875 | 5/1982 | Lightfoot | 242/55.53 |
| 4,389,132 | 6/1983 | Valadez . | |

FOREIGN PATENT DOCUMENTS

| | | | |
|---|---|---|---|
| 2748090 | 10/1977 | Fed. Rep. of Germany | 401/195 |
| 1043580 | 11/1953 | France | 401/195 |
| 451281 | 9/1949 | Italy | 401/99 |
| 507393 | 12/1954 | Italy | 401/99 |
| 280859 | 10/1952 | Switzerland | 401/52 |
| 475856 | 9/1969 | Switzerland | 401/52 |
| 1320668 | 6/1973 | United Kingdom | 401/57 |
| 1403321 | 8/1975 | United Kingdom | 401/195 |

*Primary Examiner*—Steven A. Bratlie

*Attorney, Agent, or Firm*—Finnegan, Henderson, Farabow, Garrett & Dunner

[57] ABSTRACT

A writing instrument A with note paper 36, 38 is disclosed which includes a retractable writing instrument carrier 10 and a paper storage chamber E from which paper may be dispensed through a dispensing slot 42 formed along a substantial portion of a barrel B of the device P. Carrier 10 includes a reservoir 12 of writing medium and a writing point 12. A thumb operator 32 provides for positioning of the carrier in a writing or retracted position. The carrier also may move axially along a slot 24 to position a spare paper roll 38 in a dispensing position as paper roll 36.

15 Claims, 1 Drawing Sheet

NOTE PEN DEVICE

BACKGROUND OF THE INVENTION

The invention relates to a writing instrument having provisions for containing note paper inside the writing instrument. Writing instruments have been proposed for containing writing paper or paper for other uses including even postage stamps or calendars.

For example, U.S. Pat. No. 4,030,842 discloses a combination writing instrument and storage device. U.S. Pat. No. 4,389,132 discloses a pen which contains eyeglass cleaner paper. U.S. Pat. No. 3,552,869 discloses a writing instrument which contains stamps that may be dispensed from the instrument. U.S. Pat. No. 2,111,362 discloses a writing instrument having a calendar contained for withdrawal.

Other writing instruments containing paper for note writing include U.S. Pat. Nos. 3,963,358, 2,601,650, 2,073,719, and 2,005,110.

The problem with the prior writing instruments containing note paper is that the supply of paper containable within the writing instrument is normally very limited. Quite often the paper is depleted when writing a note is desired. Part of the reason for limited paper is because, in the case of a pen, the paper roll is normally carried concentrically with the pen refill cartridge. The ink cartridge reduces the space within the barrel of the writing instrument in which paper may be rolled and stored. This is often the case where the writing instrument is of the type that includes a retractable pen point due to the conventional construction of such pens as operated by a thumb buttom such as shown in U.S. Pat. No. 4,030,842. If the note paper in the writing instrument is depleted too quickly without additional paper supply, the instrument becomes only a writing instrument and no longer serves as a note pen. Typically, in the prior writing instruments with note paper, there is no provision for storage of multiple paper rolls so that if paper is depleted then extra back-up paper is not available. If the paper is depleted, quite often, the supply of note paper is in a different location than where the pen user is. The practicality and paper availability in prior note taking writing instruments has been limited by their adherence to the constructional features of the conventional writing instruments rather than any new combination and configuration.

Accordingly, an important object of the present invention is to provide a combined writing instrument device with note paper which takes into consideration the functions of both note taking and writing to provide a new construction for such a device.

Still another important object of the present invention is to provide an efficient combination for a note paper containing writing instrument device.

Still another object of the invention is to provide a writing instrument which contains note paper and has a provision for containing an extra supply of note paper such as in the form of a spare paper roll to use if the main roll should be depleted. In this manner, extra note taking paper may always be included in the pen when paper is depleted. The pen may then be replenished with a new paper roll so that there is always a spare paper roll in the writing instrument.

SUMMARY OF THE INVENTION

The provision for a spare paper roll and for a writing instrument in which a plurality of paper rolls may be contained is provided in accordance with the present invention by utilizing a retractable writing instrument in which the writing medium is contained within the point of the instrument so that it does not extend the entire length of the barrel of the instrument. In this way, the barrel of the instrument may be advantageously used for plural paper rolls so that a spare paper roll may be used at all times. The retracting mechanism for retracting the writing point may be done quite advantageously by utilizing a simplified carrier in which no spring is needed to retract the device, but merely the manual movement of the device between a retracted and a writing position with positive locking means provided at each position. Also quite advantageously, the invention utilizes a rotating cap which has a sharpened or serrated edge to facilitate tearing of the note paper once withdrawn from the writing instrument. The same rotating cap may be utilized to close the paper space and also to ensure that a marginal edge of the paper is always available for grasping and paper withdrawal. The rotating cap serves as an end cap for the writing instrument which is removable so that paper rolls may be easily replenished. The overall construction has the advantage that it provides a quite attractive design which may be hand held in a convenient manner and results in a balanced writing instrument. The instrument may be used for pencil or ink writing, but is most advantageously used for ink writing in which an ink reservoir containing cartridge may be easily carried adjacent the writing end of the writing instrument and may be retracted or extended in a quick and reliable manner.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
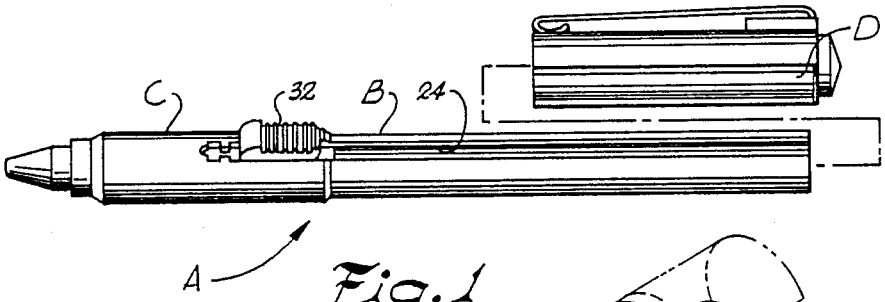
FIG. 1 is an isometric view of a note paper/writing instrument device constructed in accordance with the invention.

Referring now to the drawings, the invention will be described in more detail. A writing instrument with note paper is denoted generally as A in the drawings and includes a main barrel portion B, a writing instrument end C, and an end cap D. While the illustrated instrument is an ink pen, it is to be understood that the writing instrument may be that of pencil lead or other writing medium without departing from the scope and spirit of the invention. However, as will become apparent, the invention has particular advantages embodied as an ink pen. With this in mind, the invention will be described as including a moveable writing cartridge 10 carried in the writing instrument end C which includes a retractable writing instrument carrier 10. Carrier 10 has an ink ball point 12 connected to it so that ink flowing through ball point 12 writes. Retractable carrier 10 may be a sealed unit with ink 14 contained therein. Alternately, and preferrably, carrier 10 is a hollow plastic cylindrical member having an open end 16 with a radial lip 18. Ink 14 is provided in the form of a cartridge 20 which may be easily snapped in and out of the open end 16. For example, cartridge 20 may be inserted through open end 16 and snapped and held in place by radial lip 18. Ball point 12 extends through a second opening 22 in a forward end of carrier 10.

Figure 2:
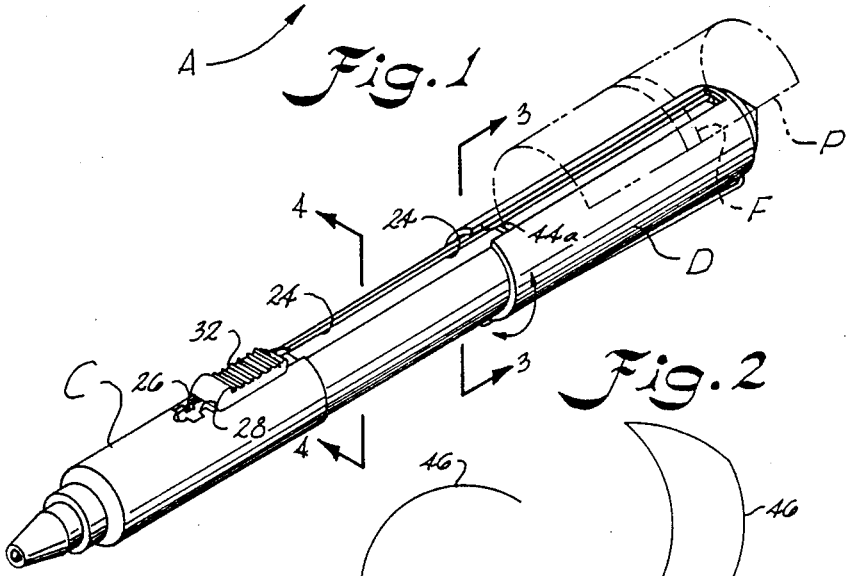
FIG. 2 is a perspective view of the note paper writing instrument with paper shown withdrawn in a phantom line.

As can best be seen in FIG. 2, there is a longitudinal slot 24 formed generally along the entire length of barrel B, except for a forwardmost end. The top end 26 of barrel B is open and is covered only by end cap D. With end cap D removed, end 26 of barrel B is completely open for insertion of carrier 10. Carrier 10 slides down slot 24 to it operational position defined by two notches 26 and 28. Notch 26 corresponds to the operational writing position. Notch 28 corresponds to the operational retracted position, as can best be seen in FIG. 4. A locking member in the form of a spring 30 resiliently engages either notch 26 or 28 to operationally positioned retractable writing instrument carrier 10. A thumb or finger operator is provided by tab 32 integral with carrier 10 and affixed thereto by a web 34 which is narrowed to extend through slot 24. Thumb tab 32 operates carrier 10 to position the writing instrument in either a writing or retracted position. It is to be understood, of course, that other means for positioning the writing point may be utilized with the major advantage of confining the reservoir of writing medium in the forward end of barrel B for purposes as will be hereinafter explained.

With retractable writing instrument carrier 10 in place, it can be seen that a plurality of paper rolls 36, 38 in a paper supply chamber E may be conveniently arranged in barrel B next to carrier 10. Paper supply chamber E corresponds to a paper dispensing portion of barrel B. The upper paper roll 36 is used as the dispensing roll and the second roll 38 serves as a spare paper roll. Preferrably, barrel B is approximately five and three-quarters inches long with an inside diameter of approximately three-eighths of an inch. The outside diameter of the barrel is preferrably about one-half inch. These dimensions are within about one-sixteenth of an inch of a conventional pen. Paper rolls 36 and 38 are approximately one and one-half inches in length and take up about three inches of the barrel length. The retractable carrier 10 occupies about two inches of space. The funnel tip of the writing instrument occupies the remaining space.

Quite advantageously, retractable carrier 10 provides an additional function besides extending and retracting ball point 12. When paper roll 36 is depleted, carrier 10 may be removed toward the open end 26 of barrel B to move spare roll 38 into the dispensing position previously occupied by roll 36. Carrier 10 is moved manually by thumb tab 32 and web 34 moving in longitudinal slot 24 opening at end 26 of barrel B. Retractable carrier 10 not only provides an efficient means for retracting a writing point, but also provides the additional function of positioning the paper supply rolls so that no additional mechanism or parts are needed for the functioning of the paper supply rolls.

Figure 4:
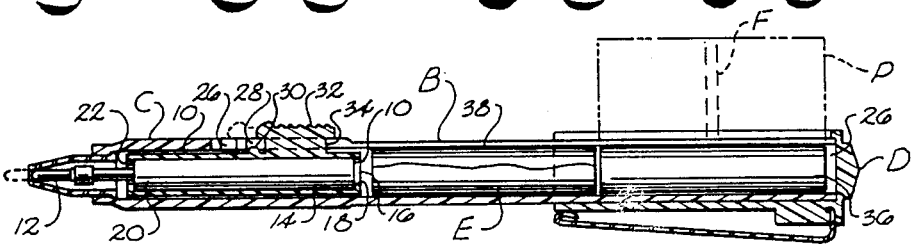
FIG. 4 is a sectional view taken along line 4—4 of FIG. 2.

As can best be seen in FIGS. 2 and 4, each roll of paper P may include a strip of adhesive F on a side thereof. Any length of paper P may be separated from the roll with adhesive for sticking onto a surface on which it is desired to leave a note. Any suitable adhesive such as that used on 3M Post-It brand note pads may be utilized. The location of the adhesive may also be varied, however, as long as it is spaced over the roll, it is assured that some adhesive will be on any size piece that is torn.

Figures 3A, 3B, 3C, 3D:
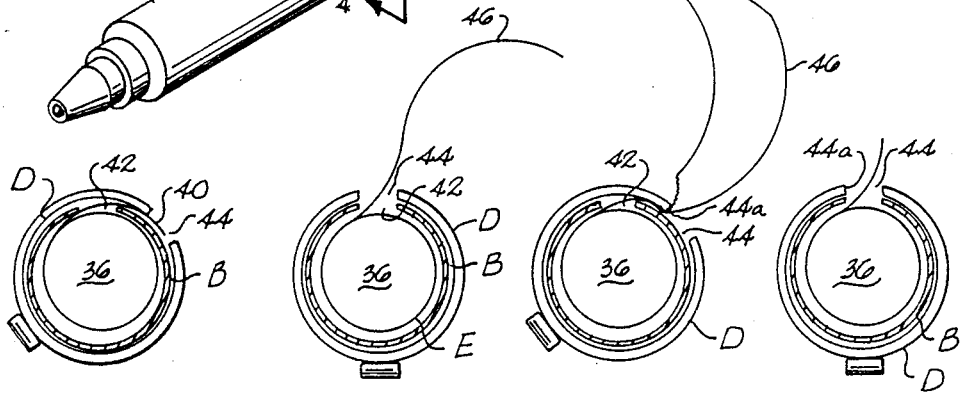
FIGS. 3*a* through 3*d* are sectional views taken along line 3—3 with a rotating end cap of the invention turned to different positions for withdrawal of note paper.

Referring now to FIGS. 3*a* through 3*d*, the operation of the device will now be described. FIG. 3*a* shows the device in a non-dispensing position in which a leading edge 40 of paper P is held between end cap D and barrel B. The leading edge 40 extends through a barrel dispensing opening 42 formed in barrel B. A similar cap dispensing opening 44 is formed in end cap D. This is the position in which the note paper will normally be held when not in use. To dispense note paper from the device, the end cap or barrel is turned so that dispensing openings 42 and 44 are aligned, as can best be seen in FIG. 3*b*. In this position, a length 46 of paper P may be unrolled as desired. Next, as can best be seen in FIG. 3*c*, end cap D is rotated over barrel B to overlap. An edge 44*a* of end cap D which defines dispensing slot 44 serves as a severance means for severing the piece of paper 46. This overlapping portion of end cap D also provides a sufficient length of paper 40 to allow the person to grip for dispensing after piece 46 has been torn. After the piece 46 of note paper has been separated from the device, end cap D automatically is in the position as shown in 3*a* holding the margin 40 of paper P in place to be gripped again.

Thus, it can be seen that an advantageous construction for a writing instrument with note paper can be had in accordance with the present invention. By including the writing medium and writing point at the lower end of a barrel, the remaining portion of the writing instrument is available for paper rolls having increased diameters since none of the diameter space is taken up with a writing cartridge. Further, this increased space provides for carrying a spare paper roll so that upon depletion of a paper roll, there is always a spare that can be used until the paper roll is replenished.

While a preferred embodiment of the invention has been described using specific terms, such description is for illustrative purposes only, and it is to be understood that changes and variations may be made without departing from the spirit or scope of the following claims.

What is claimed is:

1. A combination writing instrument and note paper dispensing device, comprising:

an elongated barrel having a writing portion and a paper dispensing portion;

a writing instrument carrier and a writing point supported by said carrier, said carrier being disposed in the writing portion of said barrel for movement between a first position in which said writing point is extended from said barrel for writing and a second position in which said writing point is retracted into said barrel;

said paper dispensing portion being disposed to receive only at least one paper roll inside said barrel;

a paper dispensing slot formed in said barrel for permitting unrolling of paper from said paper roll through said slot; and operator means for operating said carrier between said first and second positions, said operator means extending through and slidably received in an elongated operator slot in said barrel, said elongated operator slot and said paper dispensing slot being connected and aligned to provide a continuous slot permitting movement of said carrier and operator means through the paper dispensing portion to a third position to move said paper roll in said barrel in an axial direction.

2. The device of claim 1, wherein said paper roll includes adhesive carried on one side along a length of said paper roll so that whenever paper is severed from said roll during dispensing there may be an adhesive backing on the paper for adherence to a surface.

3. A combination writing instrument and note paper supply device, comprising:

an elongated barrel having a writing end and a paper dispensing portion;

a writing instrument carrier and a writing point supported by said carrier, said carrier being disposed in the writing end of said barrel for movement between a first position in which said writing point is extended from said barrel for writing and a second position in which said writing point is retracted into said barrel wherein said carrier is disposed for selective movement to a third operational position in said paper dispensing portion;

paper rolls contained in said barrel;

a paper dispensing slot formed in said barrel for permitting unrolling of paper from one of said paper rolls disposed in said barrel through said slot, said paper dispensing slot extending from said first position of said carrier to said third position;

operator means extending through and slidably received in said paper dispensing slot for operating said carrier between said first, second and third positions, wherein movement of said carrier to said third position effects axial movement of said paper roll contained in said barrel; and adhesive means carried on one side of said paper roll along a length of said paper roll.

4. A combination writing and note paper dispensing instrument comprising:

an elongated barrel having a writing portion and a paper dispensing portion;

a paper supply chamber formed within said paper dispensing portion of said barrel beginning at an end of said writing portion of said barrel and terminating at a remote end of said paper dispensing portion of said barrel, said paper supply chamber containing at least one roll of note paper;

a writing instrument carrier disposed in its entirety within the writing portion of said barrel, a writing instrument carried by said writing instrument carrier, wherein said carrier has a first position in which said writing instrument is extended for writing, a second position in which said writing instrument is retracted into the writing portion of said barrel in a non-writing position and wherein said carrier is disposed for selective movement to a third operational position in said paper dispensing portion, movement of said carrier to said third operational position effecting axial movement of said roll of said note paper contained in said paper supply chamber;

operator means formed integral with said writing instrument carrier for operating said carrier between said first, second and third positions; and an axial slot formed in said barrel for dispensing paper outwardly through said slot, said axial slot extending from said first position of said carrier to said third position, and wherein said operator means is selectively, slidably received in said axial slot.

5. The apparatus of claim 4 wherein:

said writing instrument carrier comprises a hollow cylindrical receptacle having opposed open ends; and said writing instrument comprises a writing medium cartridge containing a writing medium disposed in said receptacle and a writing point extending from said cartridge through one open end of said receptacle.

6. The apparatus of claim 5, wherein said cylindrical receptacle comprises a radial lip extending inwardly adjacent said other end holding said cartridge in place.

7. The device of claim 4, wherein said operator means comprises a resilient member carried by said carrier which may be releasably engaged in at least first and second notches formed in said writing portion of said barrel, said notches retaining said carrier in said first and second positions.

8. The device of claim 4, wherein said paper dispensing portion of said barrel includes an open end remote from the writing portion of said barrel in which said carrier and paper supply rolls may be inserted, an end cap carried on said paper dispensing portion for closing said open end, said end cap having a cap dispensing opening through which paper is dispensed when aligned with said axial slot.

9. The device of claim 8, wherein said end cap may be rotated to close said axial slot.

10. The device of claim 4 wherein said paper roll supply chamber located in said paper dispensing portion of said barrel adjacent said writing portion is opened for containing only note paper rolls having a generally solid paper diameter.

11. The device of claim 4 wherein said at least one roll include adhesive carried on one side of said note paper.

12. The device of claim 11 including in combination with said paper supply chamber a pair of axially arranged paper rolls disposed within said chamber.

13. A combined writing and note paper dispensing device comprising:

an elongated barrel defining an axial bore and having opposed open ends, said barrel including a writing portion and a paper dispensing portion, said bore of said paper dispensing portion being disposed to carry only a plurality of axially aligned paper rolls;

a writing instrument carrier disposed in its entirety within the writing portion of said barrel;

a retractable writing instrument carried by and projecting from said carrier, wherein said carrier has a first position in which said writing instrument is extended through one of said open ends of said barrel for writing, a second position in which said writing instrument is retracted into said barrel writing portion in a non-writing position, and a third position in which said carrier is moved into said paper dispensing portion;

a paper dispensing slot formed in said barrel through which paper may be selectively unrolled from said paper rolls, said paper dispensing slot extending from said first position of said carrier to said third position;

operator means extending through and slidably received in said paper dispensing slot for operating said carrier between said first, second and third positions, wherein when said operating means moves said carrier to said third position said paper rolls are moved axially in said paper dispensing portion; and cover means covering the other open end of said barrel through which said note paper rolls may be inserted.

14. The device of claim 13, wherein said cover means includes an end cap with a paper dispensing opening, said end cap having a first position covering said paper dispensing slot and a second position wherein said paper dispensing opening is aligned with said paper dispensing slot to permit selective removal of paper from said paper roll outwardly from said barrel and end cap when in said second position.

15. The device of claim 13, wherein said paper rolls include adhesive carried on one side of said note paper.

* * * * *